United States Patent [19]

Gwon

[11] 4,068,323

[45] Jan. 17, 1978

[54] ATHLETIC PROTECTIVE SYSTEM

[76] Inventor: Pu Gill Gwon, P.O. Box 36, Florissant, Mo. 63033

[21] Appl. No.: 729,910

[22] Filed: Oct. 6, 1976

[51] Int. Cl.[2] ..... A42B 3/02

[52] U.S. Cl. ..... 2/413; 2/425

[58] Field of Search ..... 2/411, 412, 413, 424, 2/425, 2, 16, 22

[56] References Cited

U.S. PATENT DOCUMENTS

| | | | |
|---|---|---|---|
| 600,778 | 3/1898 | Frazier | 2/413 |
| 1,144,150 | 6/1915 | Marcovsky | 2/2 |
| 1,714,275 | 5/1929 | Mullins | 2/425 |
| 2,296,335 | 9/1942 | Brady | 2/412 |
| 3,174,155 | 3/1965 | Pitman | 2/411 |
| 3,866,909 | 2/1975 | De Santis | 2/411 X |
| 3,934,271 | 1/1976 | Rhee | 2/424 |

*Primary Examiner*—Alfred R. Guest

*Attorney, Agent, or Firm*—Lionel L. Lucches

[57] ABSTRACT

A protective system for use in athletic contests is provided which includes at least one protective member designed to be worn over a portion of the body. Each of the members includes a main protective part constructed from resilient foam means covered by a pliable casing. The resilient foam means and casing define a first plane of protection for the user. Each member of the protective system also has a plurality of air pockets formed on and extending outwardly from the plane of the main protective part. The air pockets are constructed from a material similar to that used for the main protective part. The air pockets include an outermost surface which defines a second plane of protection for the user. In the preferred embodiment, the protective system includes a head protector and a device worn around a person's midsection for protecting the rib cage and adjacent areas.

8 Claims, 10 Drawing Figures

ATHLETIC PROTECTIVE SYSTEM

BACKGROUND OF THE INVENTION

This invention relates to a protective system, and in particular, to a system for increasing the protection afforded while maintaining mobility of the user. While the invention is described with particular application to karate and other martial art sports, those skilled in the art will recognize the wider applicability of the inventive principles disclosed hereinafter.

In the sport of karate and other martial art forms, various blows are directed toward an opponent's body and head, using the hands, fists, arms or feet. Since the blows are directed toward an opponent's body, they can result in injury unless the blow is stopped prior to actual physical contact. In certain sports, in particular karate, exhibitions and contests are held and points are scored for blow delivery. The system of grading and spectator appeal of the sport have been handicapped because blow delivery must be impeded if personal injury is to be avoided.

The prior art, in attempting to deal with this problem, reveals a number of devices offering protection against blows delivered by an opponent. My invention may be distinguished from the prior art in a number of material aspects. Because of the strenuous activity conducted while the user is wearing any proposed protective system, the components of the system must permit complete freedom of movement. The components must offer ease of use. The system also must provide superior protection while affording the advantages of mobility and ease of use. My invention accomplishes these objectives by providing a protective system, the individual components of which are constructed from a soft, resilient foam material encapsulated in a tough, pliable casing. The material and casing of a main protective part for each component of the system provide one zone of protection. In addition, each of the components of the protective system described hereinafter have a plurality of air pockets formed above and extending outwardly from the plane defined by the surface area of the main protective part. The outer boundaries of the air pockets, which are constructed from material similar to that used for the main protective part, provides a second plane of protection about the vital body areas so that even the hardest blows may be delivered in practice or in competitive situations without injury. The extra protection afforded by this additional protective zone is accomplished without restricting the mobility of the user.

One of the objects of this invention is to provide a low-cost protective system which does not restrict the wearer's movements during use.

Another object of this invention is to provide a protective system that affords extra protection to the wearer without restricting the mobility of the wearer.

Another object of this invention is to provide a protective system which utilizes predeterminedly and strategically located air pockets to define a first plane of protection for the wearer, while the surface of the main protective part forms a second plane of protection for the wearer.

Other objects will be apparent to those skilled in the art in light of the following description and accompanying drawings.

SUMMARY OF THE INVENTION

In accordance with this invention, generally stated, a protective system is provided which affords two planes of protection to the user. The system includes at least one protective member constructed from a foam material enclosed in a pliable unitary covering. The foam material defines a first plane of protection. Each element of the protective system also has a plurality of air pockets attached to it. The air pockets are predeterminedly positioned and include an outer boundary of foam material which delimits a second plane of protection for the user.

DESCRIPTION OF THE PREFERRED EMBODIMENT

Figure 1:
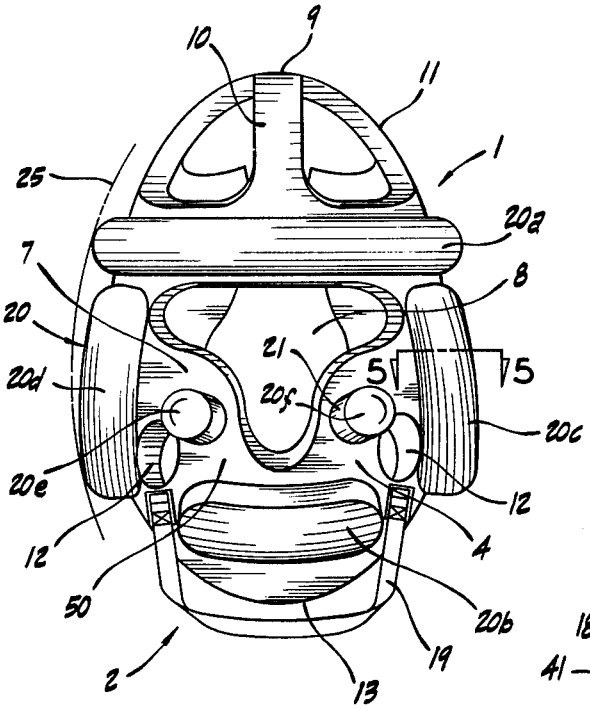
FIG. 1 is a front elevational view of one illustrative element of protective system of this invention.
Figure 5:
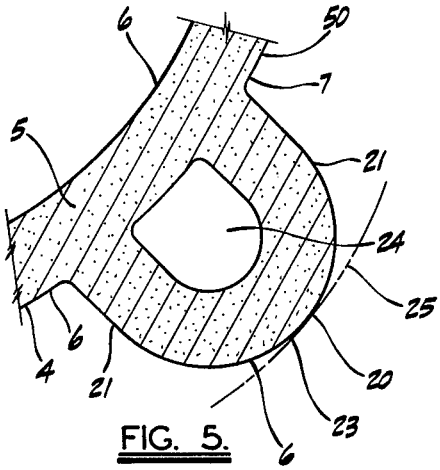
FIG. 5 is an enlarged sectional view taken along the line 5—5 of FIG. 1.
Figure 2:
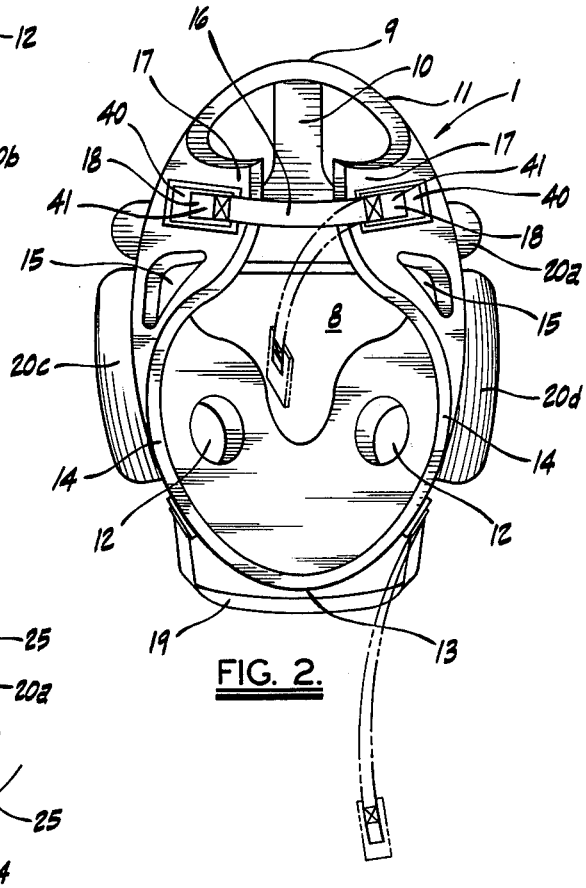
FIG. 2 is a rear view of the element shown in FIG. 1.
Figure 6:
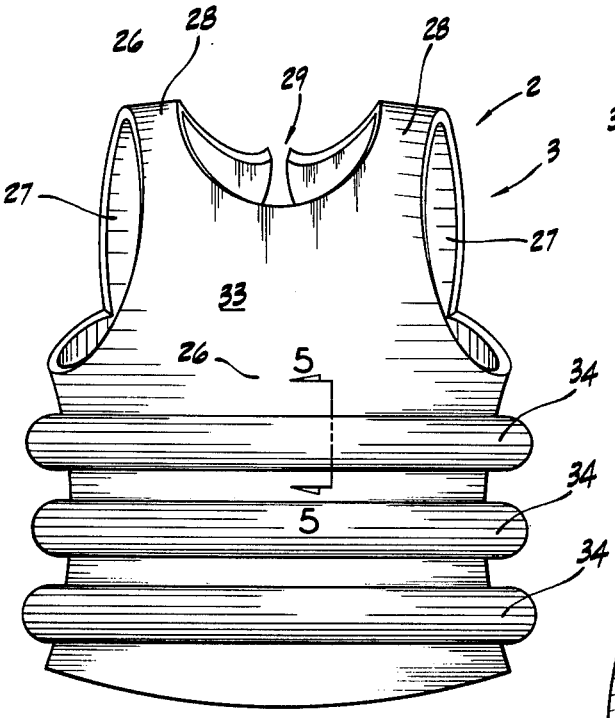
FIG. 6 is a front view of a second illustrative element of protective system of this invention.
Figure 10:
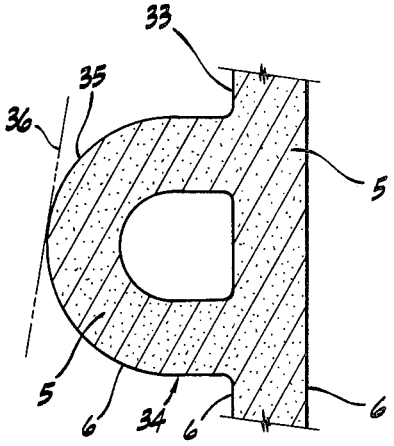
FIG. 10 is an enlarged sectional view, partly broken away, taken along the line 10—10 of FIG. 6.

Referring now to FIG. 1, reference numeral 1 indicates a helmet assembly constituting a first element of a protection system 2. A body protector assembly 3 constituting a second element of the protection system 2 is shown in FIG. 6. Preferably, both elements of the protection system 2 are worn simultaneously with one another. However, those skilled in the art will recognize that the elements may be used independently, if desired.

The helmet assembly 1 includes a main protective part 4, generally delimiting a first plane of protection 50 defined by an outer boundary of the material used to construct the helmet assembly 1. Preferably, that material is a unitary, molded or die cut design constructed from suitable resilient material 5 capable of absorbing energy such as a plastic polystyrene or polyurethane foam, or the like. A material particularly well suited for the helmet assembly 1 is available under the trademark "Ensolite" from the Expanded Products Department, Uniroyal, Inc. The material 5 preferably is provided with a suitable surface coating or casing 6 which entirely covers the resilient material. The coating 6 may be applied to the resilient material 4 by dipping or other method of application. As indicated, the main protective part 4 delimits a first plane of protection 50 for the helmet assembly 1.

The helmet assembly 1 generally conforms to the shape of the wearer's head, and includes a surface 7 coterminous with the outer boundary of first plane of protection 50. The surface 7 has a plurality of openings formed in it, including a relatively large central opening 8 for the eyes and nose of the wearer. A top 9 of the helmet assembly 1 has a rearwardly extending strap 10 and a transverse strap 11 integrally formed with one another. Except for the areas of the straps 10 and 11, the top 9 is open for ventilating purposes. The surface 7 also has a pair of openings 12 in it, which again are used to provide ventilation along the facial cheek area of the wearer.

The surface 7 is contoured so that it extends beneath the chin of the wearer along a bottom 13. The surface 7 also is contoured along a periphery 14 so that it protects the lower jawbone and covers the ears of the wearer. A pair of openings 15 serve as openings for the ears, providing ventilation along the side of the head. The periphery 14 is further formed so as to define a pair of arms 17 which project rearwardly of the head of the wearer.

A first strap 16 is attached across the open back of the helmet assembly 1 near the top 9, and in particular is attached to the helmet assembly 1 along the arms 17. Preferably, the strap 16 is constructed from an elastic material. The strap 16 is attached to the helmet assembly 1 by a closure means 18. Closure means 18 includes a first part 40 and a second part 41. The parts 40 and 41 may be, and preferably are, a "Velcro" material. The part 40 is mounted to respective ones of the arm pair 17, while the part 41 terminates each end of the strap 16. Other closure means are compatible with the broader aspects of this invention.

A second strap 19 is attached to the surface 7 near the bottom 13 of that surface. The strap 19 construction and termination is similar to that just described in conjunction with the strap 16. The straps 16 and 19 maintain the helmet assembly 1 secured to the head of the wearer.

Figure 3:
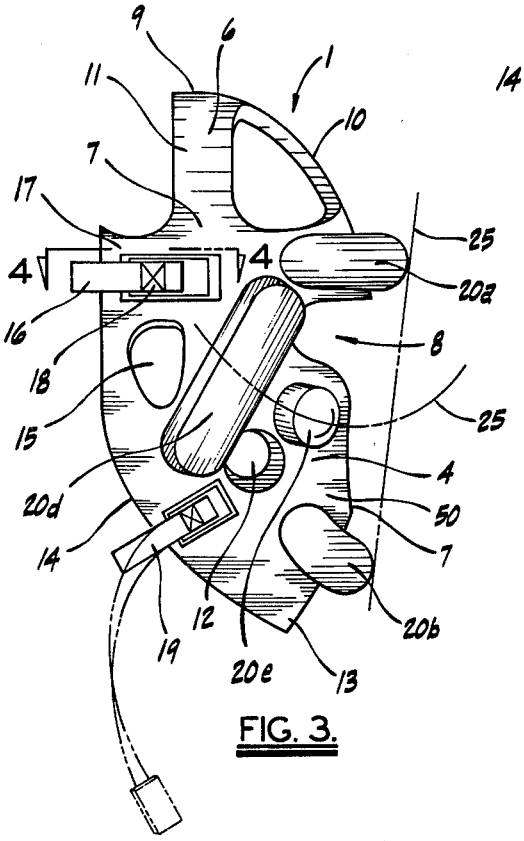
FIG. 3 is a view in side elevation of the element shown in FIG. 1.
Figure 4:
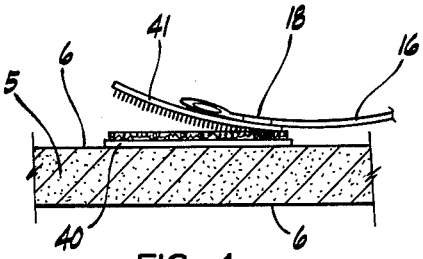
FIG. 4 is a sectional view taken along the line 4—4 of FIG. 3.

The surface 7 has a plurality of air pockets 20 extending outwardly from it. Air pockets 20 include a pair of horizontally extending members 20*a* and 20*b*, a pair of vertical members 20*c* and 20*d*, and a pair of circular members 20*e* and 20*f*. Each of the air pockets 20 are closed ended, having a side wall 21 extending outwardly from the surface 7 of the helmet assembly 1, and a top wall 23 which together delimit an air cavity 24. While the air pockets 20 are described as being segmentally constructed with sides, closed ends and a top, those skilled in the art will recognize that the air pocket may be formed from a single piece of material, if desired. In any event, the use of reference numerals for the sides and top are made for the purposes of this specification as an aid in description, and need not necessarily appear in other embodiments of this invention. The important feature of the air pockets 20 is that they are positioned about the surface 7 and extend outwardly from it. Consequently, as may be observed in FIGS. 1 and 3, the air pockets 20 are located and constructed so that they define a second plane of protection 25 for the helmet assembly 1. The second plane of protection 25 permits the helmet assembly 1 to give added protection to those areas of the head most easily damaged in competitive martial art competition. That is, the air pockets 20 are positioned to prevent the hand or foot of one opponent from striking the eyes, nose, chin, cheeks or jaws of another opponent. This is an important feature of my invention, and the two plane concept of protection defined by the outer boundary of the air pockets 20 enables the system 2 of this invention to provide improved protection, without hindering the mobility of the wearer.

The concept of a dual plane of protection also is incorporated in the body protection assembly 3 shown in FIG. 6. As there illustrated, body protector assembly 3 is an open backed device or vest having a front panel 26 extending from the open backed portion in a wrap-around design, so as to cover the rib cage and stomach areas of the wearer. The panel 26 is cut away at 27 to permit outward passage of the arms of the wearer along each side of the front panel. The panel 26 is sculptured to define shoulder straps 28, and a central opening 29 for the head and neck.

Again, the device preferably is unitary and formed or molded from a suitable resilient material 5, which is capable of absorbing energy. A suitable coating or casing 6 encloses the material 5.

Figure 7:
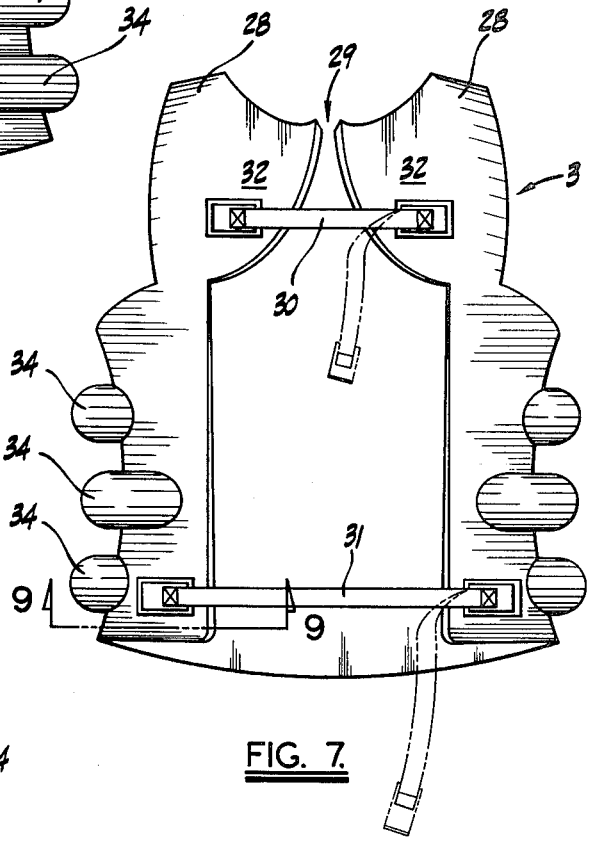
FIG. 7 is a rear view of the element shown in FIG. 6.
Figure 8:
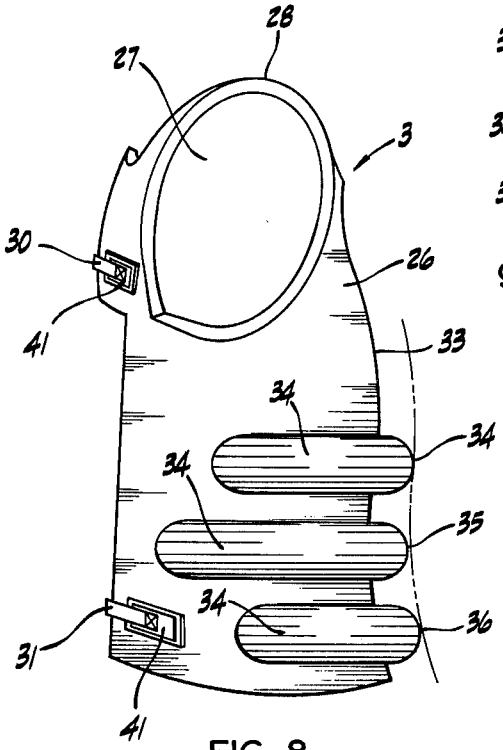
FIG. 8 is a side elevational view of the element shown in FIG. 6.
Figure 9:
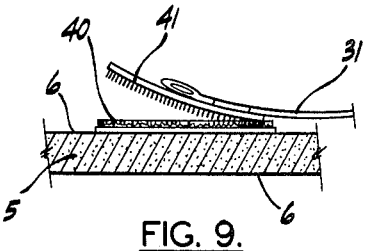
FIG. 9 is a sectional view taken along the line 9—9 of FIG. 7.

A pair of straps 30 and 31 are provided along the upper and lower portions of the body protector 3, upper and lower being referenced to FIG. 7. The straps 30 and 31 are similar to the straps 19 described in conjunction with the element of the system 2 shown in FIG. 1, and are not described in detail. It may be noted that the shoulder straps 28 are formed to include wing portions 32 for protecting the shoulder blades and for providing a mounting area for the strap 31.

Again, the front panel 26 defines a first plane of protection 33 for the body protector assembly 3.

A plurality of air pockets 34 extends circumferentially about the frong panel 26. The pockets 34 are arranged on the front panel 26 in some predetermined configuration. In the embodiment illustrated, three of the air pockets 34 are arranged parallelwise across the front surface of the panel 26. That is to say, the air pockets 34 extend from approximately beneath cut away 27 for one arm position of the wearer circumferentially to the opposite cut away 27 for the other arm position. At least one of the air pockets 34 further is extended so as to provide additional protection to the kidney areas of the wearer.

The air pockets 34 are constructed in a manner similar to that described in conjunction with the air pockets 20. As with the pockets 20, an outer boundary 35 of the air pockets 34 defines a second plane of protection 36. Use of the air pockets 34 enables the body protector 3 to offer superior protective capabilities while exhibiting lower weight than other prior art designs.

Numerous variations, within the scope of the appended claims, will be apparent to those skilled in the art in light of the foregoing description and accompanying drawings. Thus, the location of the air pockets 20 and 34 may vary in other embodiments of this invention. Likewise, the design silhouette and opening location of the helmet assembly and the body protection assembly 3 may vary. Details of air pocket construction may be changed. Thus, the pockets may be formed from a single material portion, or the structure defining the pockets may be manufactured in sections and later interconnected to define the air pockets. Various other attachment means may be used for the straps described, if desired. These variations are merely illustrative.

Having thus described the invention, what is claimed and desired to be secured by Letters Patent is:

1. A protective helmet for use in athletic contests to protect the wearer against blows struck by an opponent in the contest, comprising:

a helmet assembly adapted to be worn on a person's head and capable of absorbing energy including resilient foam means covered by a pliable casing, said foam means defining a first plane of protection for the wearer, said helmet having at least one opening in it generally conforming to a person's eyes and nose;

a pattern of enclosed air pockets defining a second plane of protection, said second plane of protection being spaced outwardly from the plane of protection defined by said resilient foam means, said air pockets being non-rupturable in normal use and being positioned on said helmet to provide protection about the opening for said eyes and nose so that said second plane of protection effectively extends along said opening; and means for securing said helmet to the wearer.

2. The protective helmet of claim 1 wherein said securing means comprises a first elastic strap means extending about the head of the wearer and a second elastic strap means extending beneath the chin of the wearer.

3. The protective helmet of claim 1 wherein said helmet assembly includes a top, said top having an opening pattern formed in it, said opening pattern defining at least a first strap and a second strap, said first strap extending longitudinally of said helmet assembly and said second strap extending transversely of said helmet assembly.

4. The protective helmet of claim 3 wherein said opening for said eyes and nose is a single opening, having at least four sides, said air pocket pattern including a first horizontally extending air pocket above a first side of said opening, a second horizontally extending air pocket below a second side of said opening, a third generally vertically extending air pocket along a third side of said opening, a second generally vertically extending air pocket along a fourth side of said opening, and a pair of generally cylindrical shaped air pockets spaced from one another and positioned near said opening inboard of said first, second, third and fourth air pockets.

5. The protective helmet of claim 4 wherein said first and second air pockets are positioned along said helmet assembly so as to generally correspond with the forehead and chin of a wearer, said third and fourth air pockets generally conform to the jaws of said wearer, and respective ones of said cylindrical shaped pair of air pockets are positioned along the cheek area of said wearer.

6. The protective helmet of claim 5 wherein said air pockets are constructed from the same material as said helmet assembly.

7. The helmet of claim 6 wherein the first and second elastic strap means are terminated in an adhering material, said helmet assembly having a complementary adhering material attached to it for interconnecting said strap means ends to said helmet assembly.

8. In a protective helmet for athletic contests, including a head shaped helmet assembly adapted to be worn by the user, said helmet assembly having at least one surface area providing a first plane of protection against blows of an opponent, the improvement which comprises means for providing a second plane of protection against blows of an opponent, said second plane providing means including a plurality of enclosed air pockets mounted to and arranged on the surface of said protective helmet, said air pockets including a wall of material delimiting an air cavity, said material wall having an outer boundary, the outer boundary of said wall defining a second plane of protection against the blows of an opponent, said second plane of protection being spaced from said first plane of protection, said material wall being non-rupturable in normal use, said protective helmet having at least one opening in it for the eyes and nose of the user, said air pockets being arranged on said surface so as to extend the second plane of protection about said opening.

* * * * *